US008720136B2

(12) United States Patent
Stenvall

(10) Patent No.: US 8,720,136 B2
(45) Date of Patent: May 13, 2014

(54) INTERNAL GLASS HOLDER

(71) Applicant: Bo Stenvall, Sävedalen (SE)

(72) Inventor: Bo Stenvall, Sävedalen (SE)

(73) Assignee: Vida International AB, Partille (SE)

( * ) Notice: Subject to any disclaimer, the term of this patent is extended or adjusted under 35 U.S.C. 154(b) by 0 days.

(21) Appl. No.: 13/827,275

(22) Filed: Mar. 14, 2013

(65) Prior Publication Data

US 2013/0269171 A1 Oct. 17, 2013

Related U.S. Application Data

(63) Continuation of application No. 10/557,907, filed as application No. PCT/SE2004/000784 on May 21, 2004.

(30) Foreign Application Priority Data

May 22, 2003 (SE) ..... 0301493

(51) Int. Cl.
*E06B 7/00* (2006.01)

(52) U.S. Cl.
USPC ..... 52/204.593; 52/204.68; 52/204.62; 52/509

(58) Field of Classification Search
USPC ..... 52/204.68, 204.593, 509, 208, 204.62
See application file for complete search history.

(56) References Cited

U.S. PATENT DOCUMENTS

| | | | |
|---|---|---|---|
| 4,241,152 | A | 12/1980 | Klink |
| 4,680,206 | A | 7/1987 | Yoxon et al. |
| 5,398,452 | A | 3/1995 | Schilde et al. |
| 5,425,208 | A | 6/1995 | Eekhout |
| 5,603,546 | A | 2/1997 | Desir, Sr. |
| 6,430,894 | B1 | 8/2002 | Chae et al. |
| 6,442,911 | B2 | 9/2002 | Elmer et al. |

FOREIGN PATENT DOCUMENTS

| | | | |
|---|---|---|---|
| CN | 2439211 | Y | 7/2001 |
| DE | 195 27 500 | A1 | 1/2007 |
| EP | 0340089 | | 11/1989 |
| EP | 0 552 101 | A1 | 7/1993 |
| FR | 2652609 | | 4/1991 |
| RU | 8722 | | 12/1998 |
| WO | WO 03/062579 | | 7/2003 |
| WO | WO 2004/104346 | A1 | 12/2004 |

OTHER PUBLICATIONS

International Seach Report dated Aug. 5, 2004 in U.S. Appl. No. 10/557,907.
Chinese Office Action dated Oct. 16, 2009 in U.S. Appl. No. 10/557,907.
Russia Decision on Grant issued in U.S. Appl. No. 10/557,907.

*Primary Examiner* — Branon Painter
(74) *Attorney, Agent, or Firm* — Harness, Dickey & Pierce, P.L.C.

(57) ABSTRACT

A glass element including at least two glass slabs arranged in facing relationship with a peripheral spacer frame arranged between each pair of glass slabs, and holders for anchorage at selective points to a supporting structure. The holders, each one of which includes two clamping plates which are joined together via connectors, are mounted exclusively in apertures formed in the glass element slab that faces the supporting structure. One of the clamping plates of each holder fitting is formed with anchorage attachment points that are accessible from the outside, and the inner clamping plates are placed in abutment against the inner face of the inner glass slab prior to the assembly of the inner glass slab and the next glass slab, in such a manner that their connecting parts extend at most up to the outer mouth of the apertures.

17 Claims, 5 Drawing Sheets

INTERNAL GLASS HOLDER

This application is a continuation application of and claims priority under 35 U.S.C. §120/121 to U.S. application Ser. No. 10/557,907 filed Nov. 22, 2005, which is a 371 of PCT/SE04/00784, filed on May 21, 2004, which claims priority to 35 U.S.C. §119 from Swedish Patent Application No. 0301493-3, filed on May 22, 2003 in the Swedish Patent Office, the contents of each of which are hereby incorporated herein by reference in their entirety and for all purposes.

TECHNICAL FIELD

Example embodiments relate to a device and a method for interconnecting two or several glass elements.

BACKGROUND

A glass element of the kind defined in the introduction is previously known from EP 0552101, wherein the inner clamping plates are glued tightly against the inner face of the inner glass slab. In order to obtain a sealed glue joint, a layer of glue of for example polyvinyl butyral is used. Many kinds of glue layers that are also sealing in some cases need a comparatively long time to solidify and thus to reach their full capacity. One consequence thereof is that for glass slabs fitted with a clamping plate a period of rest therefore is necessary, before the outer clamping plates can be joined together with the inner clamping plates.

SUMMARY

Example embodiments relate to a glass element including at least two glass slabs arranged in facing relationship with a peripheral spacer frame arranged between each pair of glass slabs, and holders for anchorage at selective points to a supporting structure. The holders, each one of which includes two clamping plates which are joined together via connectors, being mounted exclusively in apertures formed in the glass element slab that faces the supporting structure, i.e., the inner glass slab, one of the clamping plates of each holder fitting being formed with anchorage attachment points that are accessible from the outside. The inner clamping plates are placed in abutment against the inner face of the inner glass slab prior to the assembly of the inner glass slab and the next glass slab, in such a manner that their connecting parts extend at most up to the outer mouth of the apertures, and that the connecting parts of the outer clamping plates, which outer clamping parts are applied to the external face in a later step, engage the connecting parts of the inner clamping plates and form the attachment points.

One object of example embodiments of the present invention therefore is to eliminate the period of rest after the application of the inner clamping plate on the inner face of the inner glass slab, making it possible to apply the outer clamping plates immediately.

Another object of example embodiments of the present invention is to provide a device that makes it possible to fit glass elements that are secured in the inner glass slab with thin glass slabs.

In accordance with example embodiments of the present invention, the glass element includes at least two glass slabs arranged in facing relationship with a peripheral spacer frame arranged between each pair of glass slabs, and holders for attachment at selected spots to a supporting structure. The holders, each one of which includes two clamping plates which are joined together via connectors, being mounted exclusively in apertures formed in the glass element slab that faces the supporting structure, i.e., the inner glass slab, one of the clamping plates of each holder fitting being formed with anchorage attachment points that are accessible from the outside, and wherein the inner clamping plates are placed in abutment against the inner face of the inner glass slab prior to the assembly of the inner glass slab and the next glass slab in such a manner that their connecting parts extend at most up to the outer mouth of the apertures, and that the connecting parts of the outer clamping plates, which outer clamping parts are applied to the external face in a later step, engage the connecting parts of the inner clamping plates and form the attachment points, in addition to which seals are applied in the aperture in the inner glass slab and the inner clamping plates are attached to the inner face of the inner glass slab. One of the advantages thus is that the sealing and the attachment features are not included in one and the same unit. Attachment to the inner face of the inner glass slab may be effected by means of an adhesive or an adhesive layer, such as, e.g., a tape that is adhesive on both sides, the adhesion force of which reaches its full capacity immediately upon application. Instead, the sealing feature is achieved independently from the attachment, in the aperture of the inner glass slab. Thus, it is without significance whether or not the sealing compound need to be cured or set but instead the outer clamping plates can be applied immediately and the glass element be mounted.

In accordance with an example embodiment of the present invention, the seal is in the form of a sealing ring. Preferably, the aperture is dimensioned such that sealing rings of standard types may be used, which is an advantage from a cost-saving point of view.

Preferably a means is arranged axially outside of the sealing ring and the means is arranged to press the sealing ring outwards into a sealing position, when a pressure is applied on the means against the inner clamping plate. By using a plastically mouldable material for the sealing ring, such as butyl, the sealing ring may be pressed outwards to further ensure the sealing effect. Preferably, the means should be less plastic in comparison with the sealing ring and be made from a material that is softer than glass, since it is in contact with the glass in the aperture in the glass slab.

A bevelled face is made on the connector parts of the inner clamping plates to guide the sealing ring, when the means and the inner clamping plates are pressed together. Owing to the provision of a bevelled face of this kind, the seal may be guided towards the periphery of the aperture and in this manner the major part of the sealing ring may be guided towards the parts where it is most needed.

In addition, channels preferably are arranged in the inner clamping plates to allow flow of air between the inner mouth of the apertures and the outer face of the inner clamping plates in the mounted position. When the sealing ring is pressed against the inner clamping plate any air remaining between the sealing ring and the clamping plate may escape through the channels.

In accordance with another example embodiment of the present invention, a device is provided in glass elements including at least two glass slabs arranged in facing relationship with a peripheral spacer frame arranged between each pair of glass slabs, and holders for attachment at selected spots to a supporting structur. The holders, each one of which includes two clamping plates which are joined together via connectors, being mounted exclusively in apertures formed in the glass element slab that faces the supporting structure, i.e. the inner glass slab, one of the clamping plates of each holder fitting being formed with anchorage attachment points that are accessible from the outside, and wherein the inner clamping plates are placed in abutment against the inner face of the inner glass slab prior to the assembly of the inner glass slab and the next glass slab, in such a manner that their connecting parts extend at most up to the outer mouth of the apertures, and that the connecting parts of the outer clamping plates, which outer clamping parts are applied to the external face in a later step, engage the connecting parts of the inner clamping plates and form the attachment points, the device arranged to interconnect, by means of the aperture in the inner glass, at least two juxtaposed/parallel glass elements and further arranged to be connected to the supporting structure, the device additionally comprising a support member arranged to allow support thereon of two glass elements arranged in juxtaposed/parallel position. The advantage of this device is that the weight of the glass element is taken by the support member and the load is transferred direct to the supporting structure. The holders mounted in the apertures in the glass elements thus will absorb the majority of forces exerted in parallel with the axes of the apertures, since it is the support members that take the weight of the glass elements. Consequently, with this device thinner glass slabs may be used for the inner glass slab in the glass elements because these glass slabs need not be dimensioned to take their own weight in the apertures.

Preferably seals are arranged in the apertures in the inner glass slab and the inner clamping plates are attached to the inner face of the inner glass slab.

In accordance with another example embodiment, a method for assembling a glass element including at least two glass slabs arranged in a facing relationship is disclosed. The method includes mounting a plurality of holders for anchoring at selective points to a supporting structure, each of the plurality of holders including an inner clamping plate adapted to be connected to an outer clamping plate via connectors, wherein the plurality of holders are mounted in apertures formed in an inner glass slab facing the supporting structure. The mounting step further includes placing the inner clamping plate in abutment against an inner face of the inner glass slab prior to an assembly of the inner glass slab and another glass slab, in such a manner that respective connecting parts extend at most up to an outer mouth of the apertures, wherein placing the inner clamping plates in abutment against the inner face of the glass slab includes attaching the inner clamping plates to the inner face of the inner glass slab with an adhesive layer being arranged between the inner clamping plates and the inner face of the inner glass slab, wherein the adhesion force of the adhesive layer is arranged to reach its full capacity immediately upon application of the inner clamping plates to the inner face of the inner glass slab, and sealing the apertures of the inner glass slabs by providing gas seals in the aperture of the inner glass slabs.

In another example embodiment, a peripheral spacer frame is arranged between each pair of glass slabs.

In another example embodiment, the method further includes applying outer clamping plates to an external face of the inner glass slab and engaging connecting parts of the outer clamping plates with the connecting parts of the inner clamping plates so as to make the anchorage attachment points accessible from the outside.

In another example embodiment, the gas seals are made of butyl.

In another example embodiment, the gas seals in the apertures in the inner glass slab include butyl and a resin member, and wherein the resin member is forced inwardly into the apertures so as to ensure that the gas seals fill up the remaining space between the inner clamping plate, the resin member and the glass slab.

In another example embodiment, the method further includes forming the gas seals by at least one sealing ring consisting of polyisobutylene.

In another example embodiment, sealing the apertures of the inner glass slabs is achieved independently from attaching the inner clamping plates to the inner face of the inner glass slab.

In another example embodiment, the method further includes arranging the gas seals around the connectors.

In another example embodiment, the method further includes forming each of the gas seals by at least one sealing ring consisting of butyl.

In another example embodiment, the method further includes forming each of the gas seals by at least one sealing ring, and positioning a member axially externally of the at least one sealing ring, the member being arranged to press the at least one sealing ring radially outwards into a sealing position when pressure is applied on the member to press against the inner clamping plate in a direction towards the inner clamping plate.

In another example embodiment, the method further includes forming a beveled face on the connecting parts of the inner clamping plates to guide the at least one sealing ring, when the member and the inner clamping plates are pressed together.

In another example embodiment, the method further includes arranging channels in the inner clamping plates in a manner allowing flow of air between the inner mouth of the apertures and the outer face of the inner clamping plates in the mounted position during assembly of the gas seals.

In accordance with another example embodiment a method for assembling a glazing system for buildings including a glass element, which includes at least an inner and an outer glass slab arranged in a facing relationship is disclosed, the inner glass slab includes at least one aperture is disclosed. The method includes mounting a plurality of holders for securing the glazing system to a building, each holder includes an inner clamping plate adapted to be joined to an outer clamping plate via connectors, wherein the holders are mounted in the aperture of the inner glass slab. The mounting includes placing the inner clamping plate in abutment against an inner face of the inner glass slab in such a manner that connecting parts of the inner clamping plate extend at most up to an outer mouth of the apertures, wherein placing the inner clamping plates in abutment against the inner face of the glass slab includes attaching the inner clamping plates to the inner face of the inner glass slab with an adhesive layer being arranged between the inner clamping plates and the inner face of the inner glass slab, wherein the adhesion force of the adhesive layer is arranged to reach its full capacity immediately upon application of the inner clamping plates to the inner face of the inner glass slab; and providing moisture impermeable gas seals in the apertures in the inner glass slab.

In another example embodiment, the moisture impermeable gas seals include butyl.

In another example embodiment, the method further includes forming the moisture impermeable gas seals by at least one sealing ring, and a member positioned axially externally of the at least one sealing ring, wherein the member being arranged to press the at least one sealing ring outwards into a sealing position when pressure is applied on the member in a direction towards the inner clamping plate.

In another example embodiment, a peripheral spacer frame is arranged between each pair of glass slabs.

In another example embodiment, the method further includes applying outer clamping plates to an external face of the inner glass slab and engaging connecting parts of the outer clamping plates with the connecting parts of the inner clamping plates so as to make anchorage attachment points accessible from the outside.

BRIEF DESCRIPTION OF THE DRAWINGS

The invention will be described in the following in more detail with reference to the accompanying drawings that for exemplifying reasons show preferred embodiments of the invention. In the drawings.

DETAILED DESCRIPTION OF EXAMPLE EMBODIMENTS

Figure 1A:
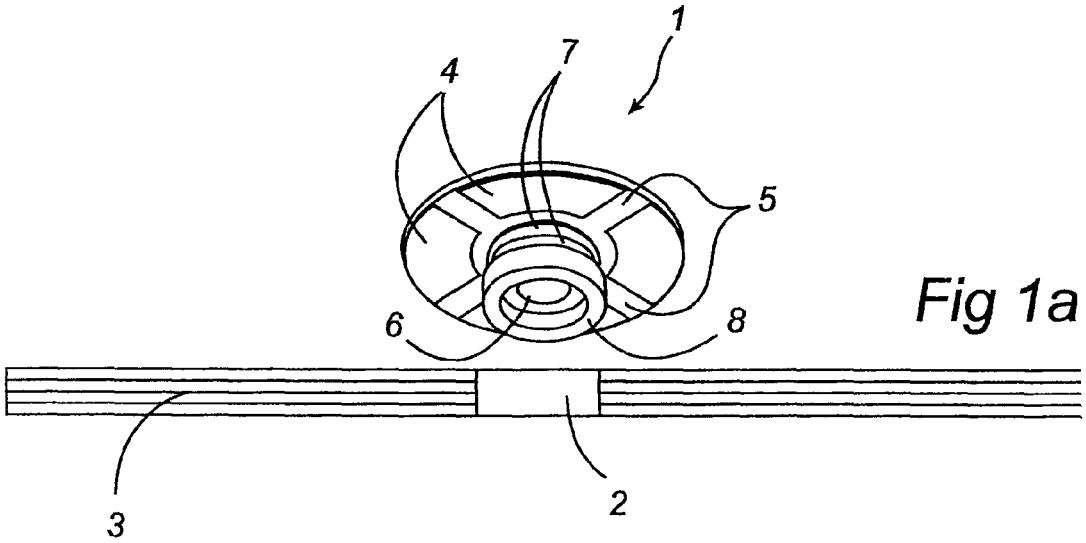
FIGS. 1*a*-1*e* show the steps of application of clamping plates on a glass slab in accordance with an example embodiment of the present invention.

Various example embodiments will now be described more fully with reference to the accompanying drawings in which some example embodiments are shown. However, specific structural and functional details disclosed herein are merely representative for purposes of describing example embodiments, and thus may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope of the disclosure.

In the drawings, the thicknesses of layers and regions may be exaggerated for clarity, and like numbers refer to like elements throughout the description of the figures.

As used herein, the term "and/or" includes any and all combinations of one or more of the associated listed items.

It will be understood that, if an element is referred to as being. "connected" or "coupled" to another element, it can be directly connected, or coupled, to the other element or intervening elements may be present. In contrast, if an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," if used herein, specify the presence of stated features, integers, steps, operations, elements and/or components, but do not preclude the presence or addition of one or more other features, integers, steps, operations, elements, components and/or groups thereof.

Spatially relative terms (e.g., "beneath," "below," "lower," "above," "upper" and the like) may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation that is above, as well as, below. The device may be otherwise oriented (rotated 90 degrees or viewed or referenced at other orientations) and the spatially relative descriptors used herein should be interpreted accordingly.

Example embodiments are described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments should not be construed as limited to the particular shapes of regions illustrated herein but may include deviations in shapes that result, for example, from manufacturing. Further, the regions illustrated in the figures are schematic in nature and their shapes do not necessarily illustrate the actual shape of a region of a device and do not limit the scope.

It should also be noted that in some alternative implementations, the functions/acts noted may occur out of the order noted in the figures. For example, the figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

To assemble a glass element in accordance with example embodiments of the present invention, an internal clamping plate 1 made from e.g., stainless steel, is initially inserted in a hole 2 formed in an inner glass slab 3, see FIG. 1*a*. The clamping plate 1 is provided with tape 4 with an adhesive on both sides in such a manner that channels 5 form extending up to the outer edge of the clamping plate 1, from a connector part 6 located in the center of the clamping plate 1. Around the connector part 6 are arranged two sealing rings 7 made from e.g., butyl and a synthetic-resin member 8. The synthetic-resin member 8 centers the connector part 6 in the aperture 2 in the glass slab 3.

Figure 1B:
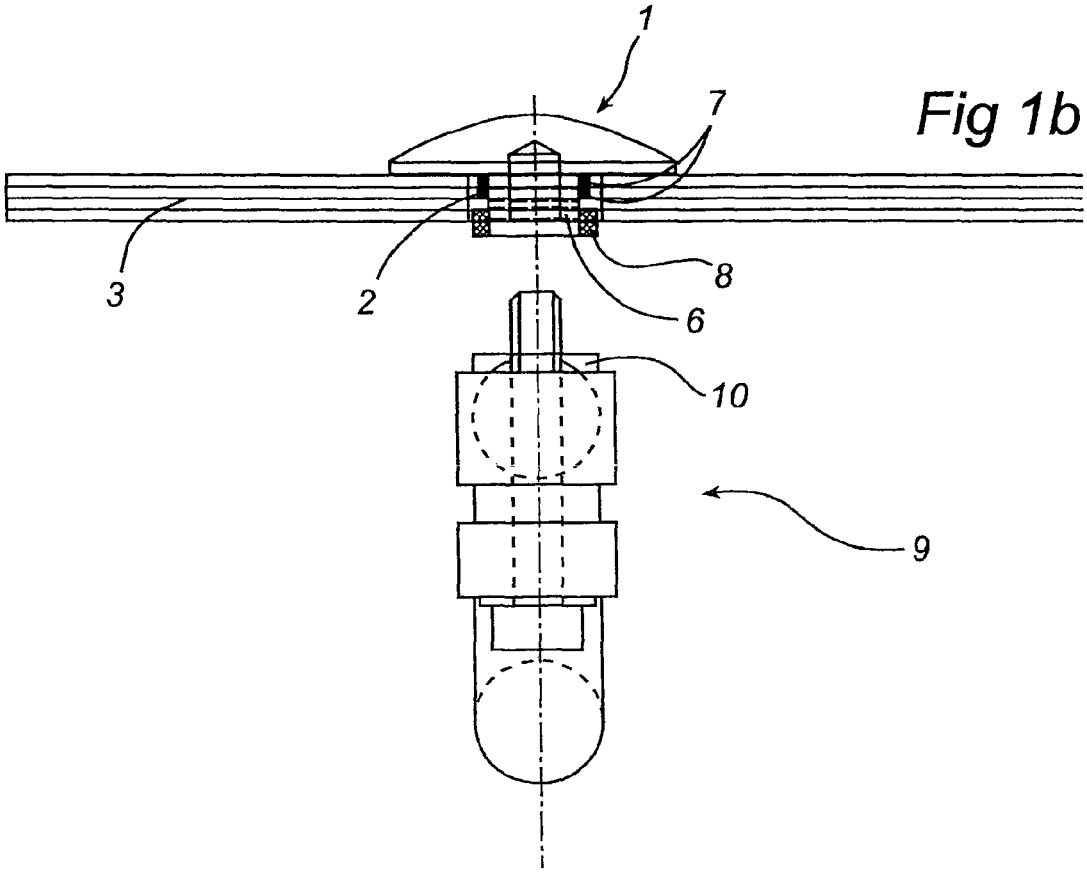
Figure 1C:
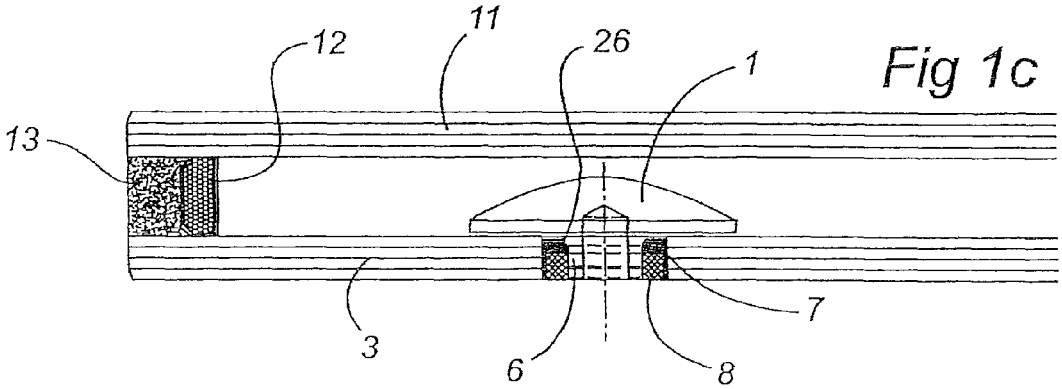

FIG. 1*b* shows the inner clamping plate 1 together with sealing rings 7 and the synthetic-resin member 8 in a partial cross-sectional view. A tool 9 is inserted into the connector part 6 in the clamping plate 1 in such a manner that an annular abutment element 10 forces the synthetic-resin member 8 inwards to ensure that the sealing rings fills up the space remaining between the clamping plate 1, the synthetic-resin member 8, and the glass slab 3, see FIG. 1*c*. An additional glass slab 11 may now be placed exteriorly of the inner glass slab 3 with the aid of a spacer frame 12 and caulking mastic 13, allowing the desired gas to be contained in the space between the glass slabs 3, 11 since it is now sealed.

Figure 1D:
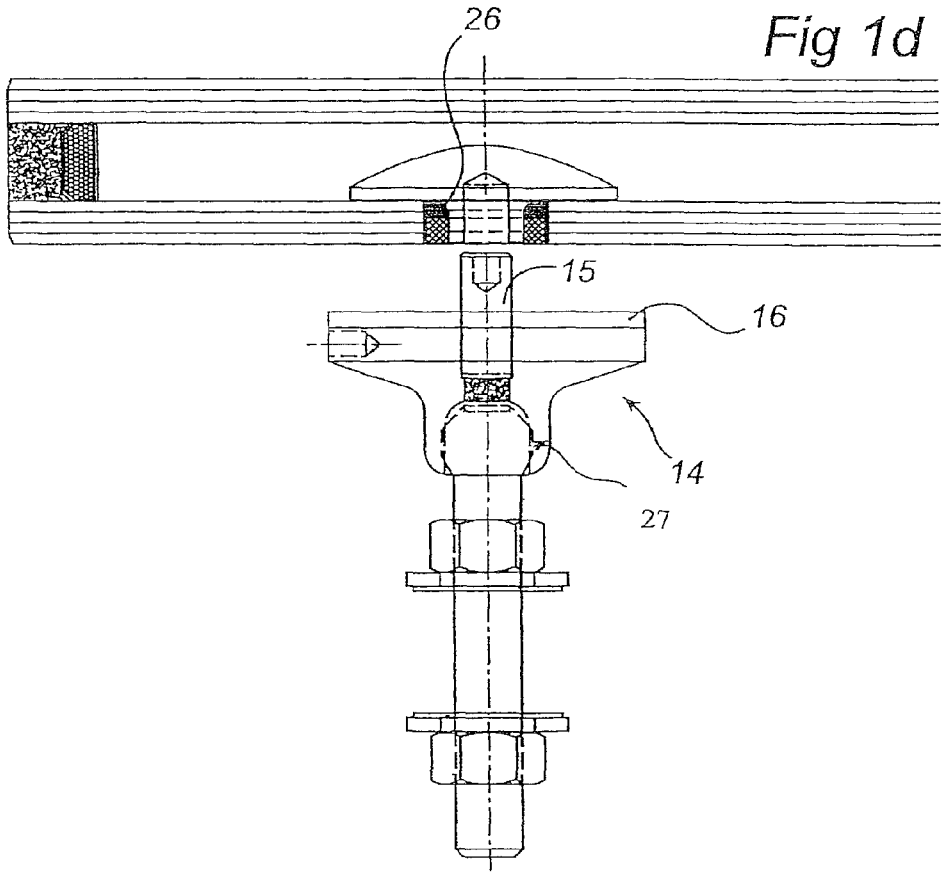

FIG. 1*d* shows the manner in which an outer clamping plate 14 with its connector part 15 are joined to the inner clamping plate 1. A synthetic-resin washer 16 preferably is inserted between the clamping plate 14 and the inner glass slab 3, when the clamping plate 14, like the inner clamping plate 1, is made from stainless steel. For example, the connector part 15 of the outer clamping plate 14 and the connector part 6 of the inner clamping plate 1 could be provided with threads to form a screw joint. In addition, the outer clamping plate 14 can be applied to an external face of the inner glass slab 3, to engage the connecting part 6 of the inner clamping plate 1 so as to make the anchorage point 27 accessible to the outside.

Figure 1E:
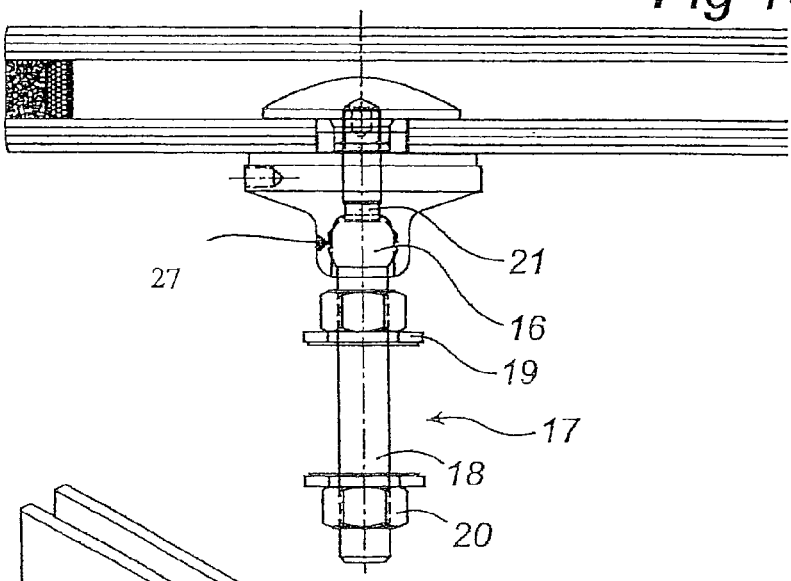

FIG. 1*e* shows the inner and the outer clamping plates 1, 14 in their final positions. In accordance with a preferred embodiment, the outer clamping plate 14 is provided with a ball joint 28, which is connected with a holder means 17. In accordance with this embodiment, the holder means consists of a threaded shaft 18 and associated washers 19 and nuts 20 for anchorage to a supporting structure (not shown). The end of the ball joint 28 facing the glass element preferably is partly flat. A rubber bushing 21 preferably is provided at the flat part of the ball joint 28 in order to guide the position of the holder means 17 relative to the outer clamping plate 14. The bushing 21 guides the holder means 17 such that the threaded shaft 18 will project essentially at right angles away from the glass element when in unloaded condition. The rubber bushing 21 thus allows some spring movement in the lateral direction.

Figure 2:
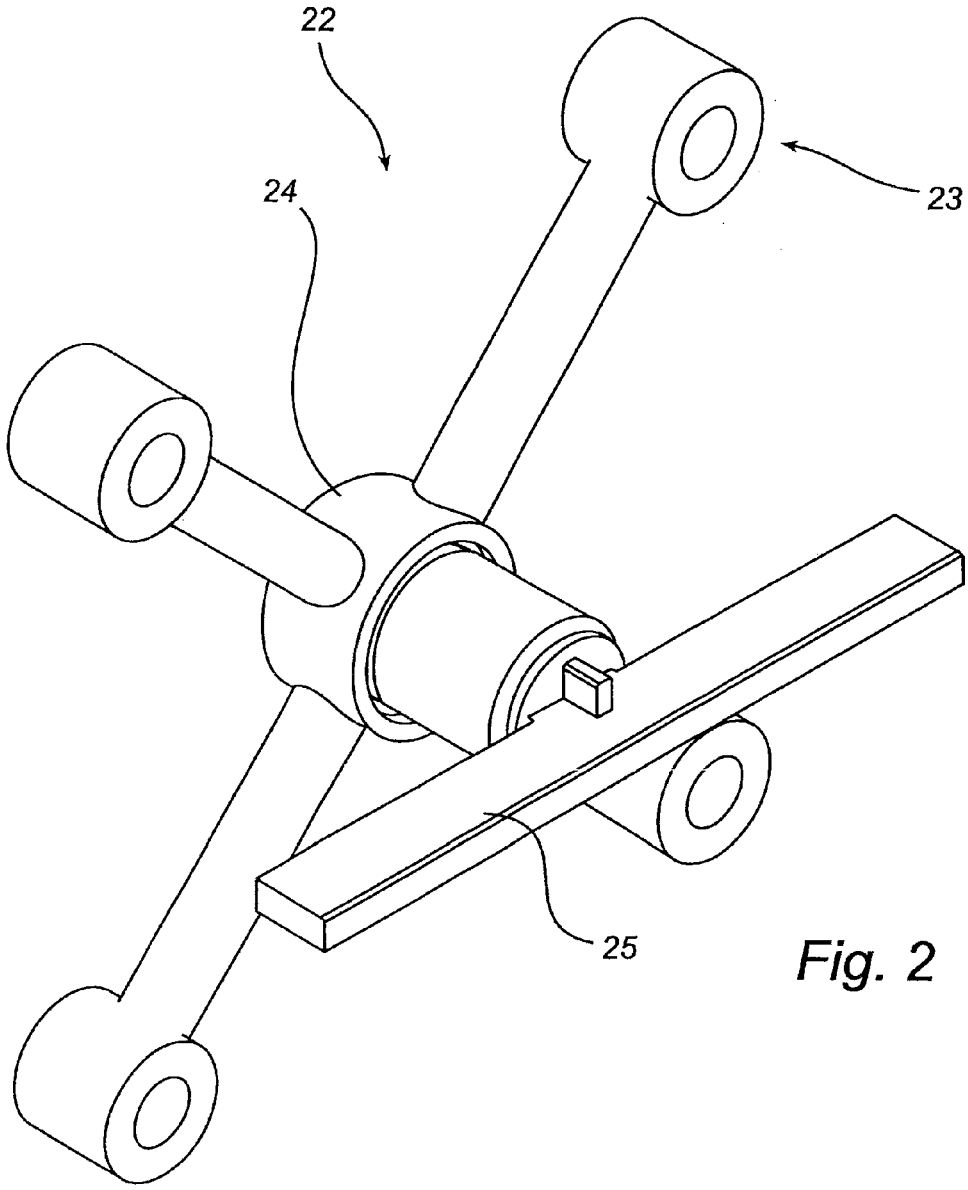
FIG. 2 shows a device comprising a support member in accordance with an example embodiment of the present invention.

FIG. 2 shows a device 22 designed to keep four glass elements together by means of holder means and supplementary means 23 on the device 22. One of the sides of the center portion 24 of the device 22 is to be attached to a supporting structure (not shown) and on its opposite side it is provided with a support member 25. On the support member 25 the upper juxtaposed glass elements may rest and consequently no gravitational pull from the weight of the glass elements is exerted on the apertures, wherein the clamping plates are positioned, but almost exclusively axial forces, i.e., forces in the same direction as the apertures, such as for example wind-generated loads.

Figure 3A:
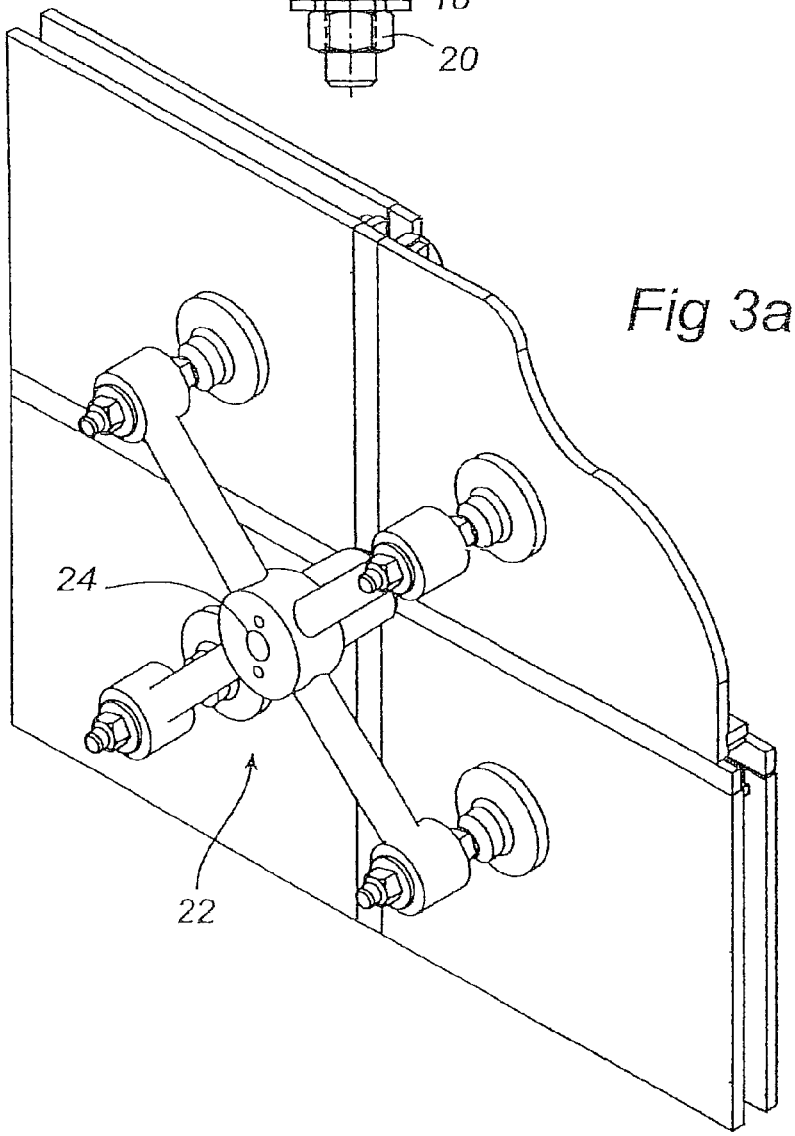
FIGS. 3*a* and 3*b* show the device of FIG. 2 as used in four glass elements.
Figure 3B:
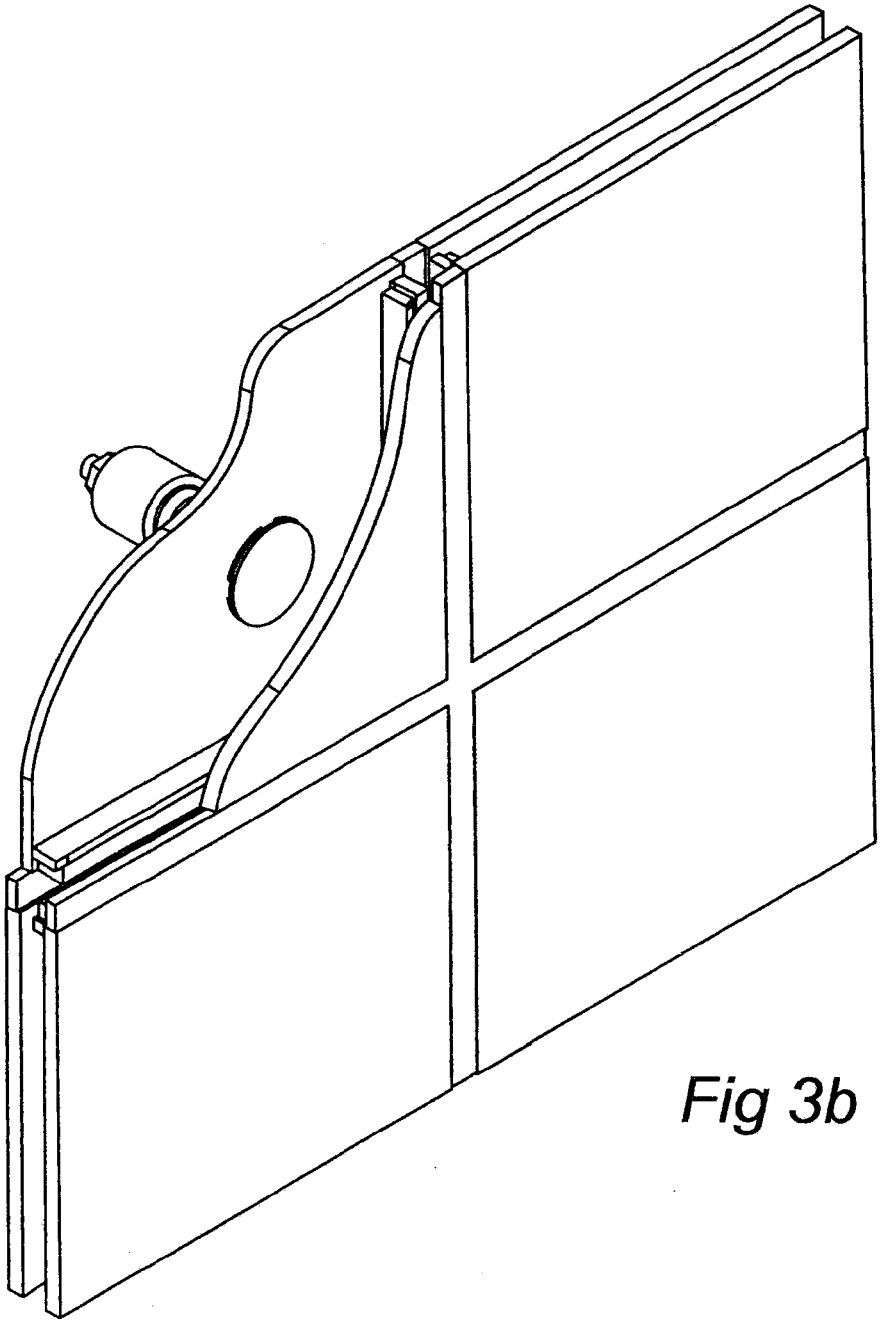

FIGS. 3*a* and 3*b* show a device 22 mounted on four glass elements. The device 22 is mounted with its center portion 24 applied directly or indirectly to the supporting structure (not shown).

As is appreciated many modifications of the above-described example embodiments are possible within the scope of protection of the present invention as defined by the claims. For example, as described above, the clamping plates could be manufactured from other materials than stainless steel, provided that they meet the demands on strength.

Additionally, the material of the components closest to the glass slabs could be made from any desired material that is sufficiently soft not to damage the glass. In addition, the connector part 15 on the outer clamping plate 14 and the connector part 6 on the inner clamping plate 1 could each one be of a kind, wherein one of the parts is pushed into the other one into engagement with one another by means of hook-shaped or barb-like means, i.e., coupling means of snap holder or bayonet fastener type.

The invention claimed is:

1. A method for assembling a glass element including at least two glass slabs arranged in a facing relationship, the method comprising:

mounting a plurality of holders for anchoring at selective points to a supporting structure, each of the plurality of holders including an inner clamping plate adapted to be connected to an outer clamping plate via connectors, and the plurality of holders being mounted in apertures formed in an inner glass slab facing the supporting structure, the mounting the plurality of holders further includes:

placing at least one gas seal around the connector of the inner clamping plate prior to insertion of the inner clamping plate into an aperture of the inner glass slab, placing the inner clamping plate in abutment against an inner face of the inner glass slab prior to an assembly of the inner glass slab and another glass slab, in such a manner that the at least one gas seal is inserted into an aperture of the inner glass slab and respective connecting parts extend at most up to an outer mouth of the apertures, wherein placing the inner clamping plates in abutment against the inner face of the glass slab includes attaching the inner clamping plates to the inner face of the inner glass slab with an adhesive layer being arranged between the inner clamping plates and the inner face of the inner glass slab, and the adhesion force of the adhesive layer is configured to reach its full capacity immediately upon application of the inner clamping plates to the inner face of the inner glass slab, and sealing the apertures of the inner glass slabs with the at least one gas seal in the aperture of the inner glass slabs.

2. The method according to claim 1, wherein a peripheral spacer frame is arranged between each pair of glass slabs.

3. The method according to claim 1, further comprising applying outer clamping plates to an external face of the inner glass slab and engaging connecting parts of the outer clamping plates with the connecting parts of the inner clamping plates so as to make the anchorage attachment points accessible from the outside.

4. The method according to claim 1, wherein the at least one gas seal is made of butyl.

5. The method according to claim 1, further comprising inserting a resin member into the aperture of the inner glass slab and forcing the resin member inwardly into the apertures so as to abut the at least one gas seal and compress the at least one gas seal to ensure that the gas seals fill up the remaining space between the inner clamping plate, the resin member and the glass slab.

6. The method according to claim 1, further comprising forming the at least one gas seal from at least one sealing ring consisting of polyisobutylene.

7. The method according to claim 1, wherein sealing the apertures of the inner glass slabs is achieved independently from attaching the inner clamping plates to the inner face of the inner glass slab.

8. The method according to claim 1, further comprising arranging the gas seals around the connectors.

9. The method according to claim 1, further comprising forming each gas seals from at least one sealing ring consisting of butyl.

10. The method according to claim 1, further comprising:

a tool axially external of the at least one gas seal, the tool being arranged to press the at least one gas seal radially outwards into a sealing position when pressure is applied on by the tool to press against the inner clamping plate in a direction towards the inner clamping plate.

11. The method according to claim 1, further comprising forming a beveled face on the connecting parts of the inner clamping plates to guide the at least one gas seal, when the member and the inner clamping plates are pressed together.

12. The method according to claim 1, further comprising arranging channels in the inner clamping plates in a manner allowing flow of air between the inner mouth of the apertures and an outer face of the inner clamping plates in the mounted position during assembly of the at least one gas seal.

13. A method for assembling a glazing system for buildings including a glass element, which includes at least an inner and an outer glass slab arranged in a facing relationship, the inner glass slab includes at least one aperture, the method comprising:

mounting a plurality of holders for securing the glazing system to a building, each holder includes an inner clamping plate adapted to be joined to an outer clamping plate via connectors, and the plurality of holders being mounted in the aperture of the inner glass slab, the mounting the plurality of holders further includes:

placing at least one moisture impermeable gas seal around the connector of the inner clamping plate prior to insertion of the at least one gas seal into an aperture of the inner glass slab, placing the inner clamping plate in abutment against an inner face of the inner glass slab in such a manner that connecting parts of the inner clamping plate extend at most up to an outer mouth of the apertures, wherein placing the inner clamping plates in abutment against the inner face of the glass slab includes attaching the inner clamping plates to the inner face of the inner glass slab with an adhesive layer being arranged between the inner clamping plates and the inner face of the inner glass slab, and the adhesion force of the adhesive layer is configured to reach its full capacity immediately upon application of the inner clamping plates to the inner face of the inner glass slab; and providing moisture impermeable gas seals in the apertures in the inner glass slab.

14. The method according to claim 13, wherein the at least one moisture impermeable gas seal includes butyl.

15. The method according to claim 13, further comprising forming the moisture impermeable gas seals from at least one sealing ring, and providing a member positioned axially externally of the at least one sealing ring, the member being arranged to press the at least one sealing ring outwards into a sealing position when pressure is applied on the member in a direction towards the inner clamping plate.

16. The method according to claim 13, wherein a peripheral spacer frame is arranged between each pair of glass slabs.

17. The method according to claim 13, further comprising applying outer clamping plates to an external face of the inner glass slab and engaging connecting parts of the outer clamping plates with the connecting parts of the inner clamping plates so as to make anchorage attachment points accessible from the outside.

* * * * *